US011320851B1

(12) United States Patent
Yeh et al.

(10) Patent No.: US 11,320,851 B1
(45) Date of Patent: May 3, 2022

(54) ALL-MOSFET VOLTAGE REFERENCE CIRCUIT WITH STABLE BIAS CURRENT AND REDUCED ERROR

(71) Applicants: NCKU Research and Development Foundation, Tainan (TW); Himax Technologies Limited, Tainan (TW)

(72) Inventors: Wei-Ting Yeh, Tainan (TW); Chien-Hung Tsai, Tainan (TW)

(73) Assignees: NCKU Research and Development Foundation, Tainan (TW); Himax Technologies Limited, Tainan (TW)

( * ) Notice: Subject to any disclaimer, the term of this patent is extended or adjusted under 35 U.S.C. 154(b) by 0 days.

(21) Appl. No.: 17/109,801

(22) Filed: Dec. 2, 2020

(51) Int. Cl.
*G05F 3/26* (2006.01)
*G05F 1/445* (2006.01)
*G05F 1/46* (2006.01)

(52) U.S. Cl.
CPC ..... *G05F 3/262* (2013.01); *G05F 1/445* (2013.01); *G05F 1/461* (2013.01); *G05F 1/468* (2013.01)

(58) Field of Classification Search
CPC ..... G05F 3/262; G05F 1/445; G05F 1/461; G05F 1/468
See application file for complete search history.

(56) References Cited

U.S. PATENT DOCUMENTS 10,585,447 B1 * 3/2020 Tanimoto ..... G05F 3/262
2008/0074148 A1 * 3/2008 Srivastava ..... H03K 19/018528 326/68
2012/0306549 A1 * 12/2012 Nagatomo ..... G05F 3/242 327/143
2015/0234401 A1 * 8/2015 Porras ..... G05F 3/24 327/513

(Continued)

OTHER PUBLICATIONS

Liu et al., "A 0.4-V Wide Temperature Range All-MOSFET Subthreshold Voltage Reference With 0.027%/V Line Sensitivity", Aug. 2018, IEEE Transactions on Circuits and Systems—II: Express Briefs, vol. 65, pp. 969-973 (Year: 2018).*

(Continued)

*Primary Examiner* — Kyle J Moody
*Assistant Examiner* — Lakaisha Jackson
(74) *Attorney, Agent, or Firm* — Donald E. Stout; Stout, Uxa & Buyan, LLP

(57) ABSTRACT

An all-MOSFET voltage reference circuit includes a first cascaded branch configured to generate a bias current and composed of a first current source and a diode-connected first N-type transistor connected at a first interconnected node; a second cascaded branch composed of a second current source, a diode-connected second N-type transistor and a third N-type transistor connected with the second N-type transistor disposed in between, wherein the second N-type transistor and the third N-type transistor are connected at a second interconnected node; a third cascaded branch composed of a third current source and a diode- (Continued)

connected fourth N-type transistor connected at an output node that provides a reference voltage; and an amplifier with a non-inverting node coupled to the first interconnected node and an inverting node coupled to the second interconnected node. A threshold voltage of the third N-type transistor is larger than a threshold voltage of the second N-type transistor.

11 Claims, 3 Drawing Sheets

(56) References Cited

U.S. PATENT DOCUMENTS

2015/0268689 A1* 9/2015 Blaauw ..... G05F 3/16
323/313

OTHER PUBLICATIONS

Wang et al., "A 0.7-V 28-nW CMOS Subthreshold Voltage and Current Reference in One Simple Circuit", Sep. 2019, IEEE Transactions on Circuits and Systems—I: Regular Papers, vol. 66, pp. 3457-3466 (Year: 2019).*

* cited by examiner

| VDD=1.8V | Medium Vth | Standard Vth |
|---|---|---|
| S | 0.361 | 0.409 |
| T | 0.261 | 0.436 |
| F | 0.161 | 0.463 |
| Total variation | ±0.1 (38%) | ±0.027 (6%) |

*FIG. 3*

ALL-MOSFET VOLTAGE REFERENCE CIRCUIT WITH STABLE BIAS CURRENT AND REDUCED ERROR

BACKGROUND OF THE INVENTION

1. Field of the Invention

The present invention generally relates to a voltage reference circuit, and more particularly to an ultra-low power all-MOSFET voltage reference circuit.

2. Description of Related Art

A voltage reference circuit is an electronic device that generates a fixed voltage (called reference voltage or Vref), which is ideally independent of process variations, power supply voltage and temperature (i.e., PVT). The voltage reference circuit may be adapted to varieties of applications such as power supplies, analog-to-digital converters, digital-to-analog converters and other control systems.

In considerations of power consumption in applications with limited power such as Internet of Things (Iot) devices, a low power or ultra-low power voltage reference circuit is greatly demanded. Yang Liu et al. disclose "A 0.4-V Wide Temperature Range All-MOSFET Subthreshold Voltage Reference With 0.027%/V Line Sensitivity," IEEE Transactions on Circuits and Systems II: Express Briefs, volume 65, no. 8, pp. 969-973, August 2018, the entire contents of which are hereby incorporated by reference. Liu's voltage reference circuit is constructed with only metal-oxide-semiconductor field-effect transistors (MOSFETs) but without bipolar junction transistors and resistors. However, Liu's voltage reference circuit is greatly susceptible to process variations. At some process corners representing the extremes of parameter variations, Liu's voltage reference circuit may even generate a reference voltage with percentage error as high as 50%.

A need has thus arisen to propose a novel voltage reference circuit that generates a reference voltage with reduced percentage error.

SUMMARY OF THE INVENTION

In view of the foregoing, it is an object of the embodiment of the present invention to provide an all-MOSFET voltage reference circuit capable of generating a reference voltage with stable bias current and a reference voltage with reduced percentage error.

According to one embodiment, an all-MOSFET (metal-oxide-semiconductor field-effect transistor) voltage reference circuit includes a first cascaded branch, a second cascaded branch, a third cascaded branch and an amplifier. The first cascaded branch is configured to generate a bias current and is composed of a first current source and a diode-connected first N-type transistor connected in series at a first interconnected node between a power supply voltage and ground. The second cascaded branch is composed of a second current source, a diode-connected second N-type transistor and a third N-type transistor connected in series with the second N-type transistor disposed in between, the second N-type transistor and the third N-type transistor being connected at a second interconnected node, and gates of the second N-type transistor and the third N-type transistor being connected together. The third cascaded branch is composed of a third current source and a diode-connected fourth N-type transistor connected in series at an output node that provides a reference voltage. The bias current is mirrored through the third current source. The amplifier has a non-inverting node coupled to the first interconnected node and an inverting node coupled to the second interconnected node. A threshold voltage of the third N-type transistor is larger than a threshold voltage of the second N-type transistor.

BRIEF DESCRIPTION OF THE DRAWINGS

FIG. 3 shows a table listing exemplary medium-type threshold voltages and standard-type threshold voltages at some process corners with corresponding process variation percentage.

DETAILED DESCRIPTION OF THE INVENTION

Figure 1:
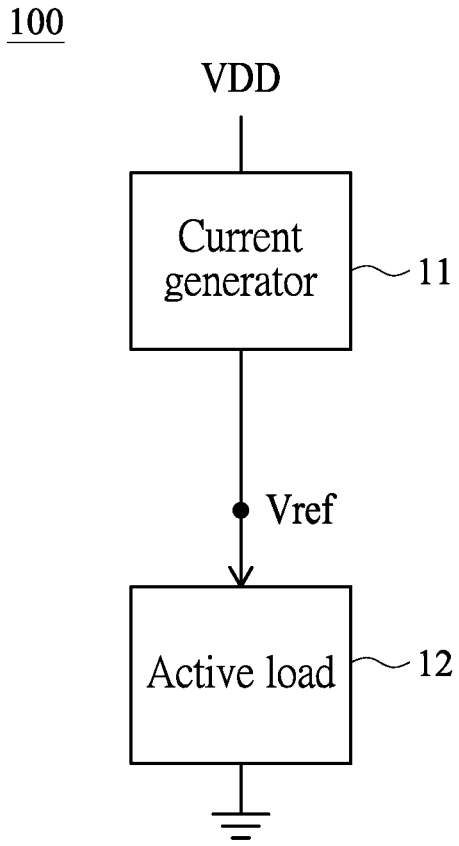
FIG. 1 shows a block diagram illustrating an all-MOSFET (metal-oxide-semiconductor field-effect transistor) voltage reference circuit according to one embodiment of the present invention.
Figure 2:
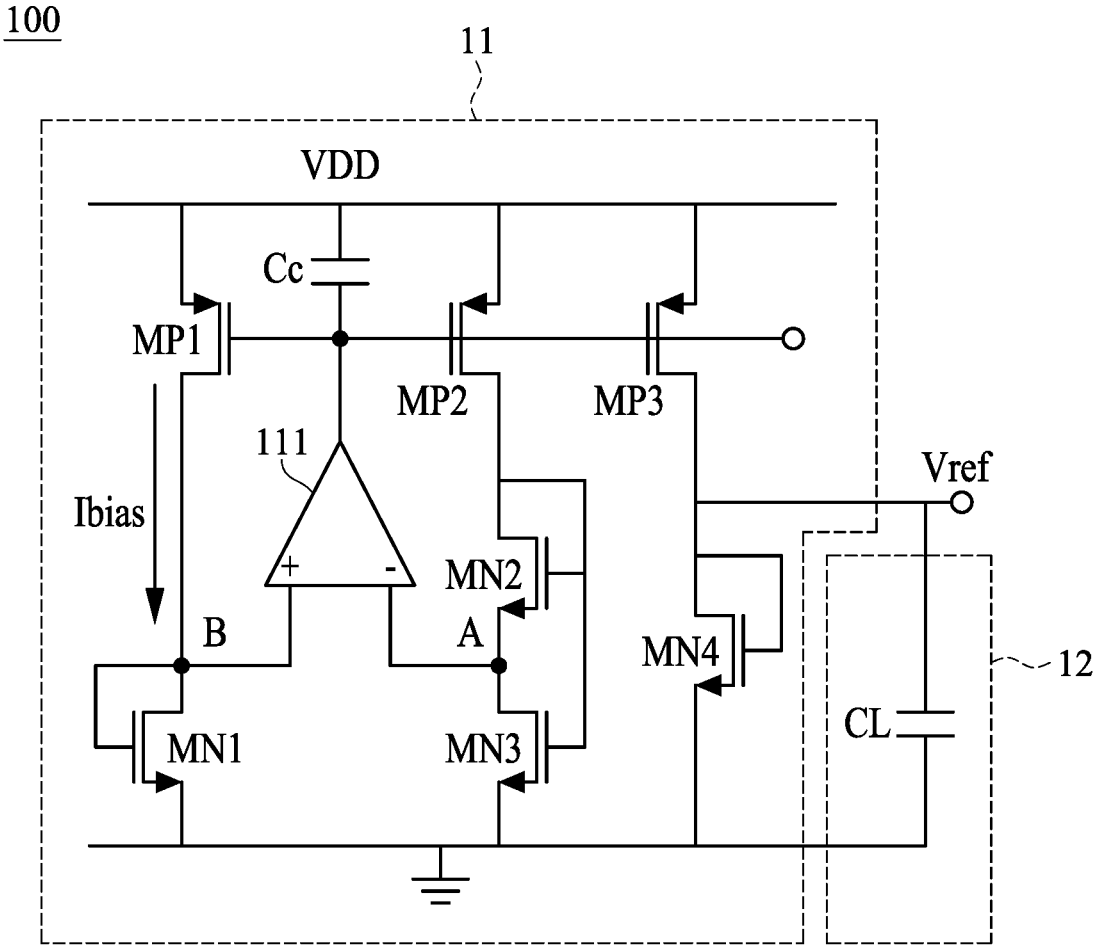
FIG. 2 shows a circuit diagram of the all-MOSFET voltage reference circuit of FIG. 1.

FIG. 1 shows a block diagram illustrating an all-MOSFET (metal-oxide-semiconductor field-effect transistor) voltage reference circuit 100 according to one embodiment of the present invention, and FIG. 2 shows a circuit diagram of the all-MOSFET voltage reference circuit 100 of FIG. 1.

In the embodiment, the all-MOSFET voltage reference circuit ("voltage reference circuit" hereinafter) 100 may primarily include a current generator 11 that is configured to generate a bias current Ibias and a reference voltage Vref, and an active load 12 that is coupled to receive the reference voltage Vref.

The current generator 11 of the embodiment may include a first cascaded branch composed of a first current source (such as a first P-type transistor MP1) and a diode-connected (i.e., with gate and drain connected) first N-type transistor MN1 connected in series at a first interconnected node B. The first current source is connected to a power supply voltage VDD (e.g., 1.8V (volts) in the embodiment) and the first N-type transistor MN1 is connected to ground. Specifically, a source of the first P-type transistor MP1 is connected to the power supply voltage VDD, drains of the first P-type transistor MP1 and the first N-type transistor MN1 are connected together at the first interconnected node B, and a source of the first N-type transistor MN1 is connected to the ground. As shown, the bias current Ibias may flow through the first cascaded stage, that is, the first P-type transistor MP1 and the first N-type transistor MN1.

The current generator 11 of the embodiment may include a second cascaded branch composed of a second current source (such as a second P-type transistor MP2), a diode-connected second N-type transistor MN2 and a third N-type transistor MN3 connected in series between the power supply voltage VDD and the ground. The second N-type transistor MN2 disposed between the second current source and the third N-type transistor MN3. The second current source is connected to the power supply voltage VDD and the third N-type transistor MN3 is connected to the ground. The second N-type transistor MN2 and the third N-type transistor MN3 are connected at a second interconnected node A. Particularly, gates of the second N-type transistor MN2 and the third N-type transistor MN3 are connected together. Specifically, a source of the second P-type transistor MP2 is connected to the power supply voltage VDD, drains of the second P-type transistor MP2 and the second N-type transistor MN2 are connected together. A source of the second N-type transistor MN2 and a drain of the third N-type transistor MN3 are connected together, and a source of the third N-type transistor MN3 is connected to the ground.

The current generator 11 of the embodiment may further include a third cascaded branch composed of a third current source (such as a third P-type transistor MP3) and a diode-connected fourth N-type transistor MN4 connected in series between the power supply voltage VDD and the ground. A source of the third P-type transistor MP3 is connected to the power supply voltage VDD, and drains of the third P-type transistor MP3 and the fourth N-type transistor MN4 are connected together at an output node that provides the reference voltage Vref. A source of the fourth N-type transistor MN4 is connected to the ground. Gates of the first P-type transistor MP1, the second P-type transistor MP2 and the third P-type transistor MP3 are connected together. The bias current Ibias is mirrored through the third P-type transistor MP3.

The current generator 11 of the embodiment may include an amplifier 111 with a non-inverting node (+) coupled to the first interconnected node B and an inverting node (−) coupled to the second interconnected node A. Accordingly, the drains of the first N-type transistor MN1 and the third N-type transistor MN3 are forced to a substantially same potential. The amplifier 111 has an output end coupled to the gates of the first P-type transistor MP1, the second P-type transistor MP2 and the third P-type transistor MP3. Moreover, an anti-noise capacitor Cc may be connected between the output end of the amplifier 111 and the power supply voltage VDD. According to the current generator 11 as described above, the bias current Ibias may be mirrored through the third P-type transistor MP3 and may enter the active load 12 via the output node Vref. In the embodiment, the active load 12 may include a load capacitor CL connected between the output node Vref and the ground.

Regarding Liu's voltage reference circuit as mentioned before, in order to ensure that the bias current Ibias flowing through the first N-type transistor (connected to the non-inverting node (+) of the amplifier) is large enough, Liu's first N-type transistor must use a MOSFET with a (smaller) medium-type threshold voltage. However, the MOSFET with a (smaller) medium-type threshold voltage has a large process variation percentage of up to 38%, thereby resulting in the bias current, for example, ranging from 90 nA to 0.8 nA and thus generating a reference voltage Vref with percentage error of up to 50%.

To the contrary, according to one aspect of the embodiment, the first N-type transistor MN1 adopts a MOSFET with a (larger) standard-type threshold voltage, which has a process variation percentage substantially smaller than the MOSFET with the medium-type threshold voltage.

FIG. 3 shows a table listing exemplary medium-type threshold voltages Vth and standard-type threshold voltages Vth at some process corners with corresponding process variation percentage.

The first N-type transistor MN1 of the embodiment adopts the MOSFET with a (larger) standard-type threshold voltage instead of a (smaller) medium-type threshold voltage as in Liu. In order to maintain the bias current Ibias (to prevent it from becoming smaller) flowing through the first N-type transistor MN1, according to another aspect of the embodiment, the third N-type transistor MN3 of the embodiment includes a MOSFET adaptable to (or designed for) a higher power supply voltage than the power supply voltage VDD of the voltage reference circuit 100, while the second N-type transistor MN2 still includes a MOSFET adaptable to the power supply voltage VDD. In the embodiment, the power supply voltage VDD of the voltage reference circuit 100 is 1.8V, and the third N-type transistor MN3 includes a MOSFET adaptable to a next higher power supply voltage of 3.3V, for example, while the second N-type transistor MN2 still include MOSFETs adaptable to the power supply voltage VDD of 1.8V. Therefore, a threshold voltage of the third N-type transistor MN3 is larger than a threshold voltage of the second N-type transistor MN2, thereby pulling up the potential at the second interconnected node A.

As the voltages at the (second/first) interconnected nodes A and B are forced to the substantially same potential (by the amplifier 111), the potential at the first interconnected node B may then be pulled up accordingly, and the bias current Ibias flowing through the first N-type transistor MN1 may therefore be increased.

Regarding Liu's voltage reference circuit as mentioned above, the second N-type transistor and the third N-type transistor must use same MOSFETs with standard-type threshold voltage and adaptable to the power supply voltage VDD, otherwise Liu's required performance cannot be achieved.

Compared to Liu's voltage reference circuit having a bias current ranging from 90 nA to 0.8 nA with percentage error of up to 50%, the voltage reference circuit 100 of the embodiment may generate a bias current Ibias ranging from 20 nA to 8.2 nA, therefore generating a reference voltage Vref with smaller percentage error of 6%.

Although specific embodiments have been illustrated and described, it will be appreciated by those skilled in the art that various modifications may be made without departing from the scope of the present invention, which is intended to be limited solely by the appended claims.

What is claimed is:

1. An all-MOSFET (metal-oxide-semiconductor field-effect transistor) voltage reference circuit, comprising:

a first cascaded branch configured to generate a bias current and composed of a first current source and a diode-connected first N-type transistor connected in series at a first interconnected node between a power supply voltage and ground;

a second cascaded branch composed of a second current source, a diode-connected second N-type transistor and a third N-type transistor connected in series with the second N-type transistor disposed in between, wherein the second N-type transistor and the third N-type transistor are connected at a second interconnected node, and gates of the second N-type transistor and the third N-type transistor are connected together;

a third cascaded branch composed of a third current source and a diode-connected fourth N-type transistor connected in series at an output node that provides a reference voltage, the bias current being mirrored through the third current source; and an amplifier with a non-inverting node coupled to the first interconnected node and an inverting node coupled to the second interconnected node;

wherein a threshold voltage of the third N-type transistor is larger than a threshold voltage of the second N-type transistors;

wherein the first N-type transistor adopts a MOSFET with a standard-type threshold voltage, which is larger than a medium-type threshold voltage.

2. The circuit of claim 1, wherein the third N-type transistor includes a MOSFET adaptable to a higher power supply voltage than the power supply voltage of the voltage reference circuit.

3. The circuit of claim 2, wherein said higher power supply voltage is 3.3V, and the power supply voltage of the all-MOSFET voltage reference circuit is 1.8V.

4. The circuit of claim 2, wherein the second N-type transistor includes a MOSFET adaptable to the power supply voltage of the all-MOSFET voltage reference circuit.

5. The circuit of claim 1, wherein the first current source comprises a first P-type transistor, the second current source comprises a second P-type transistor, and the third current source comprises a third P-type transistor.

6. The circuit of claim 5, wherein a source of the first P-type transistor is connected to the power supply voltage, drains of the first P-type transistor and the first N-type transistor are connected together at the first interconnected node, and a source of the first N-type transistor is connected to the ground.

7. The circuit of claim 5, wherein a source of the second P-type transistor is connected to the power supply voltage, drains of the second P-type transistor and the second N-type transistor are connected together, a source of the second N-type transistor and a drain of the third N-type transistor are connected together, and a source of the third N-type transistor is connected to the ground.

8. The circuit of claim 5, wherein the third P-type transistor has a source connected to the power supply voltage and a drain connected to the output node; gates of the first P-type transistor, the second P-type transistor and the third P-type transistor are connected together; and the fourth N-type transistor has a drain connected to the output node, and a source connected to the ground.

9. The circuit of claim 5, wherein the amplifier has an output end coupled to gates of the first P-type transistor, the second P-type transistor and the third P-type transistor.

10. The circuit of claim 9, further comprising:

an anti-noise capacitor connected between the output end of the amplifier and the power supply voltage.

11. The circuit of claim 1, further comprising:

an active load that is coupled to receive the reference voltage.

* * * * *